US012768054B2

(12) United States Patent
Oraby

(10) Patent No.: US 12,768,054 B2
(45) Date of Patent: Oct. 20, 2026

(54) METHODS AND SYSTEMS FOR PRODUCING HYDROGEN GAS USING ELECTROLYSIS OF SALT WATER USING ELECTRODE WITH SEDIMENTARY ROCK PORTION

(71) Applicant: The American University in Cairo, Cairo (EG)

(72) Inventor: Moustafa ElSayed Oraby, New Cairo (EG)

(73) Assignee: THE AMERICAN UNIVERSITY IN CAIRO, Cairo (EG)

( * ) Notice: Subject to any disclaimer, the term of this patent is extended or adjusted under 35 U.S.C. 154(b) by 628 days.

(21) Appl. No.: 18/220,100

(22) Filed: Jul. 10, 2023

(65) Prior Publication Data

US 2024/0011163 A1 Jan. 11, 2024

Related U.S. Application Data

(60) Provisional application No. 63/359,605, filed on Jul. 8, 2022.

(51) Int. Cl.
*C25B 1/04* (2021.01)
*C25B 11/02* (2021.01)
(Continued)

(52) U.S. Cl.
CPC ..... *C25B 1/04* (2013.01); *C25B 11/02* (2013.01); *C25B 11/067* (2021.01); *C25B 11/089* (2021.01)

(58) Field of Classification Search
CPC ... C25B 11/047; C25B 11/051; C25B 11/057; C25B 11/067; C25B 11/077; C25B 13/04; C25B 13/07; C25B 1/04
See application file for complete search history.

(56) References Cited

U.S. PATENT DOCUMENTS 2,973,428 A * 2/1961 Pfeiffer ..... B23K 35/365 219/146.1
3,216,919 A 11/1965 White et al.
(Continued)

FOREIGN PATENT DOCUMENTS

CN 111074291 A 4/2020
ES 2593354 T3 12/2016
(Continued)

OTHER PUBLICATIONS

Erin I. Garcia De Jesus, "Stanford researchers create hydrogen fuel from seawater," Stanford News (Mar. 18, 2019).

*Primary Examiner* — Michael E Barr
*Assistant Examiner* — Colton Busa Forry
(74) *Attorney, Agent, or Firm* — Jenkins, Taylor & Hunt, P.A.

(57) ABSTRACT

A method for producing hydrogen gas through electrolysis of a salt water solution using an electrode with a sedimentary rock portion includes placing a first electrode comprising a metallic material in a salt water solution. The method further includes placing a second electrode comprising a metallic material portion and a sedimentary rock portion into the salt water solution. The method further includes allowing the salt water solution to permeate at least a portion of the sedimentary rock portion. The method further includes connecting a direct current (DC) power supply to the first and second electrodes. The method further includes applying, using the power supply, a DC voltage between the first and second electrodes, thereby causing electrolysis of at least a portion of the salt water solution and producing hydrogen gas.

16 Claims, 16 Drawing Sheets

(51) Int. Cl.
*C25B 11/067* (2021.01)
*C25B 11/089* (2021.01)

(56) References Cited

U.S. PATENT DOCUMENTS

| | | | | |
|---|---|---|---|---|
| 10,487,408 | B2 * | 11/2019 | Rothschild | C25B 1/04 |
| 2024/0410062 | A1 | 12/2024 | Oraby | |

FOREIGN PATENT DOCUMENTS

| | | | | |
|---|---|---|---|---|
| WO | WO 2016/079746 | A1 | 5/2016 | |
| WO | WO-2019160701 | A1 * | 8/2019 | C25D 11/36 |
| WO | WO 2019/180717 | A1 | 9/2019 | |

* cited by examiner

METHODS AND SYSTEMS FOR PRODUCING HYDROGEN GAS USING ELECTROLYSIS OF SALT WATER USING ELECTRODE WITH SEDIMENTARY ROCK PORTION

PRIORITY CLAIM

This application claims the priority benefit of U.S. Provisional Patent Application Ser. No. 63/359,605, filed Jul. 8, 2022, the disclosure of which is incorporated herein by reference in its entirety.

TECHNICAL FIELD

The subject matter described herein relates to hydrogen gas production. More particularly, the subject matter described herein relates to methods and systems for electrolysis of salt water using an electrode with a sedimentary rock portion.

BACKGROUND

Hydrogen gas can be produced by placing electrodes in salt water and applying a DC voltage to the electrodes immersed in the salt water. Conventionally, the electrodes used for electrolysis are metallic electrodes. Using metallic electrodes results in corrosion of the electrodes and can also result in excessive chlorine production.

There exists a need for electrolysis of a salt water solution that avoids at least some of these difficulties.

SUMMARY

A method for producing hydrogen gas through electrolysis of a salt water solution using an electrode with a sedimentary rock portion includes placing a first electrode comprising a metallic material in a salt water solution. The method further includes placing a second electrode comprising a metallic material portion and a sedimentary rock portion into the salt water solution. The method further includes allowing the salt water solution to permeate the sedimentary rock portion. The method further includes connecting a direct current (DC) power supply to the first and second electrodes. The method further includes applying, using the power supply, a DC voltage between the first and second electrodes, thereby causing electrolysis of at least a portion of the salt water solution and producing hydrogen gas.

BRIEF DESCRIPTION OF THE DRAWINGS

Exemplary implementations of the subject matter described herein will now be explained with reference to the accompanying drawings, of which.

DETAILED DESCRIPTION

The subject matter described herein includes a design of the positive electrode for use in the electrolysis operation for extracting green hydrogen gas from salt water, including, but not limited to, sea water, enabling the positive electrode to resist the corrosion process. The subject matter described herein also enables continuous, uninterrupted, and a high rate of hydrogen production with no limits on the applied power during the electrolysis operation. The operation is uninterrupted because of reduced corrosion of the electrodes during electrolysis and reduced deposits of metal oxides in the water over conventional methods using only metallic electrodes. Rather than being deposited in the water between the electrodes, chlorine remains largely in the voids of the sedimentary rock core.

Exemplary Methodology

The Earth's crust was formed millions of years ago through accumulation of grains of sediments, referred to as sedimentary rock. The three major sedimentary rocks in nature known to Earth scientists are sandstone, limestone, and dolomite. All sediments have two properties, porosity and permeability, that differentiate one sediment from the other. Porosity is the percentage of voids in the sedimentary rock with respect to its total volume. These voids are filled with water at the surface. Permeability is the measure of the easiness of the fluids inside the rock to move between the rock pores.

The sediments that are on the surface have high porosity and high permeability due to the low pressure, referred to as overburden pressure by Earth scientists, exerted on the rock.

The porosity and permeability are routine measurements that are performed in a core laboratory.

Figure 1:
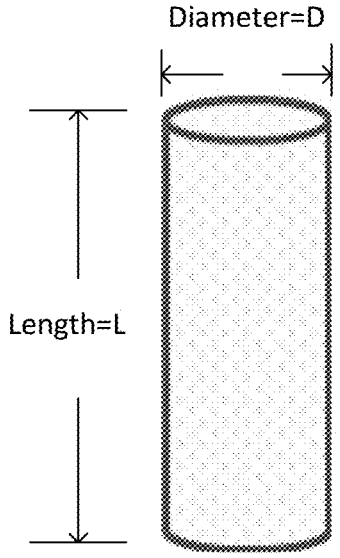
FIG. 1 is a schematic diagram of a sedimentary rock core suitable for electrolysis of a salt water solution.

The measurements of porosity and permeability are performed on core sediment plugs as shown in FIG. 1. In FIG. 1, the sedimentary rock core plug comprises a cylinder with length L and diameter D. The sedimentary rock core plug illustrated in FIG. 1 can be used as part of an electrode for electrolysis of a salt water solution to produce hydrogen gas. The parameters D and L may be selected depending on the desired voltage to be applied to the electrolyte solution. For example, the resistance of the sedimentary rock core can be controlled by choosing D and L according to the following equation:

$$R = \rho \frac{L}{A}$$

where R is the resistance, ρ is the resistivity of the sedimentary rock core, L is the length of the core, and A is the cross sectional area of the core. R governs the amount of voltage drop across the sedimentary rock core.

In addition, while FIG. 1 illustrates a sedimentary rock core having a cylindrical geometry, other geometries can be used without departing from the scope of the subject matter described herein. For example, as will be described in more detail below, in an alternate implementation, the sedimentary rock core may comprise any geometric shape with a hollow interior cavity, such as a cylindrical cavity.

Examples of porosity and permeability measurements for surface plugs (i.e., sedimentary rock plugs obtained from rocks on the surface of the Earth's crust) are shown in Table 1. The measurements show that almost 30% of the volume is pores while 70% is rock grains. Also, the permeability can reach up to 600-700 millidarcy, indicating easiness of fluid movements across the plug. When a plug is saturated with high saline water, the electrical resistance of the plug is very low.

values in Table 1. For example, in Table 1, the porosities range from about 29.5% to about 32% and the permeabilities range from about 40 millidarcy (md) to about 660 md. However, porosities and permeabilities in ranges outside of those exemplified by Table 1 can be used without departing from the scope of the subject matter described herein.

Figure 2:
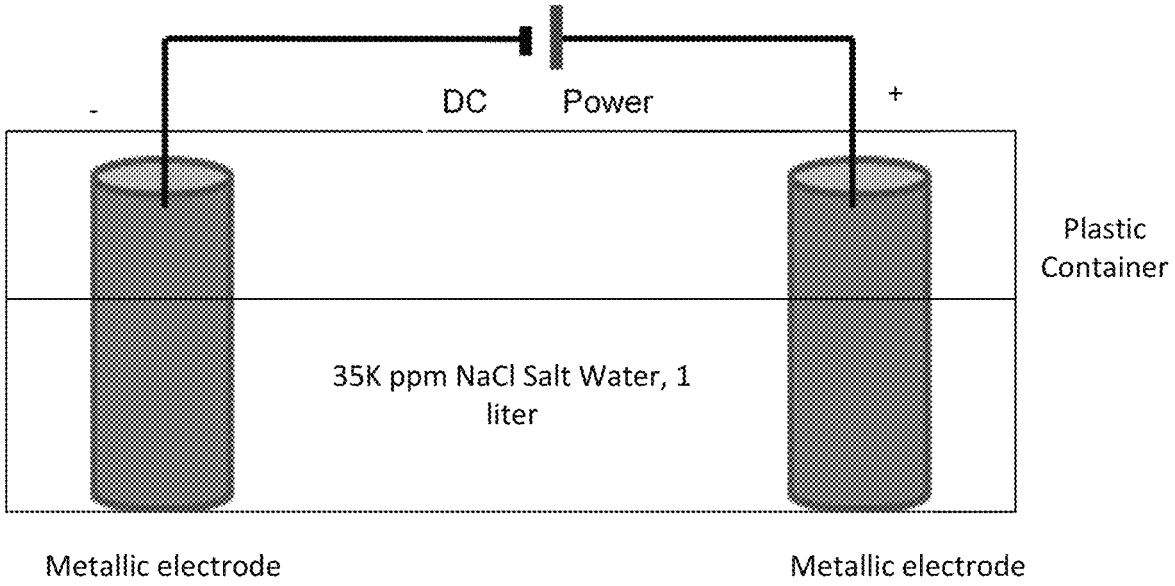
FIG. 2 is a schematic and circuit diagram illustrating an exemplary setup for electrolysis using metallic electrodes.

The classical art of water electrolysis is to use two metallic electrodes, one is connected to the negative charge while the other is connected to the positive charge of the electric current. The electric current source can be solar panel, or any other source of a direct current called DC current. FIG. 2 represents the experiment performed in a laboratory. The DC current is generated using a DC current generator that generates DC voltage up to 32 volts and DC current up to 5 amperes. This power supply can insert very high power of up to 160 watts per second.

FIG. 2 is a schematic diagram illustrating electrolysis using metallic electrodes. In FIG. 2, the metallic electrodes are placed in a plastic container and partially submerged in salt water. A DC power supply is connected between the electrodes to apply a DC voltage, which causes electrolysis of the salt water and produces hydrogen gas. However, as stated above, using electrodes composed entirely of metals results in corrosion and decreased hydrogen production and excessive chlorine production.

Figure 3:
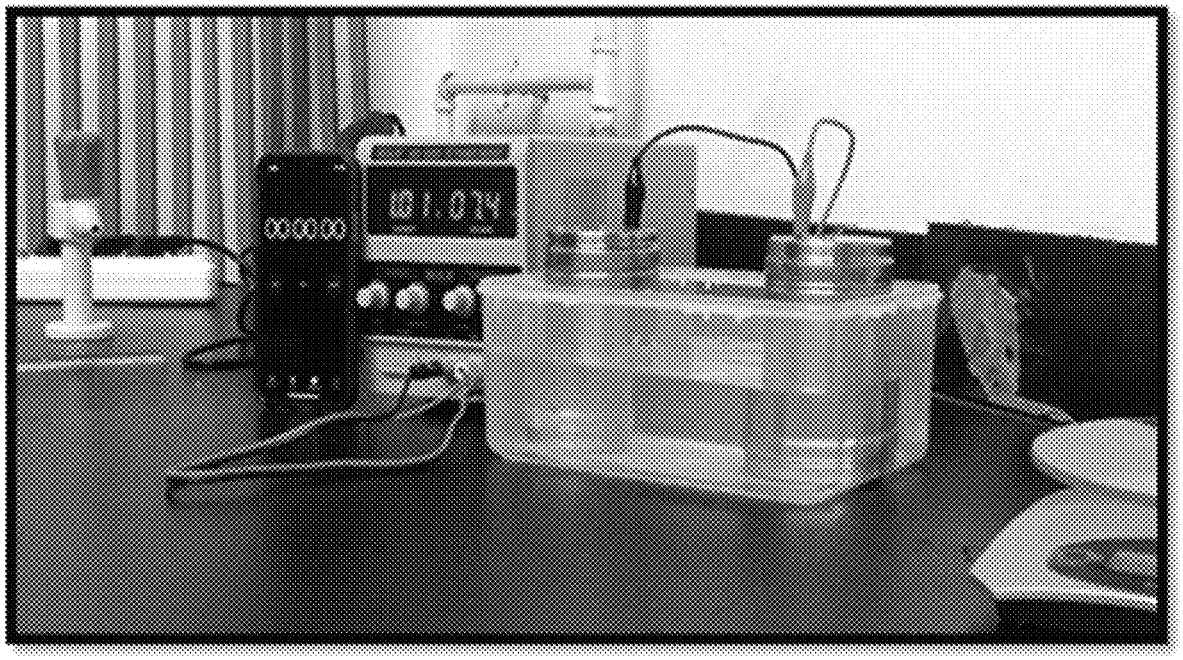
FIG. 3 is an image of a lab experiment of electrolysis using metallic electrodes.
Figure 4:
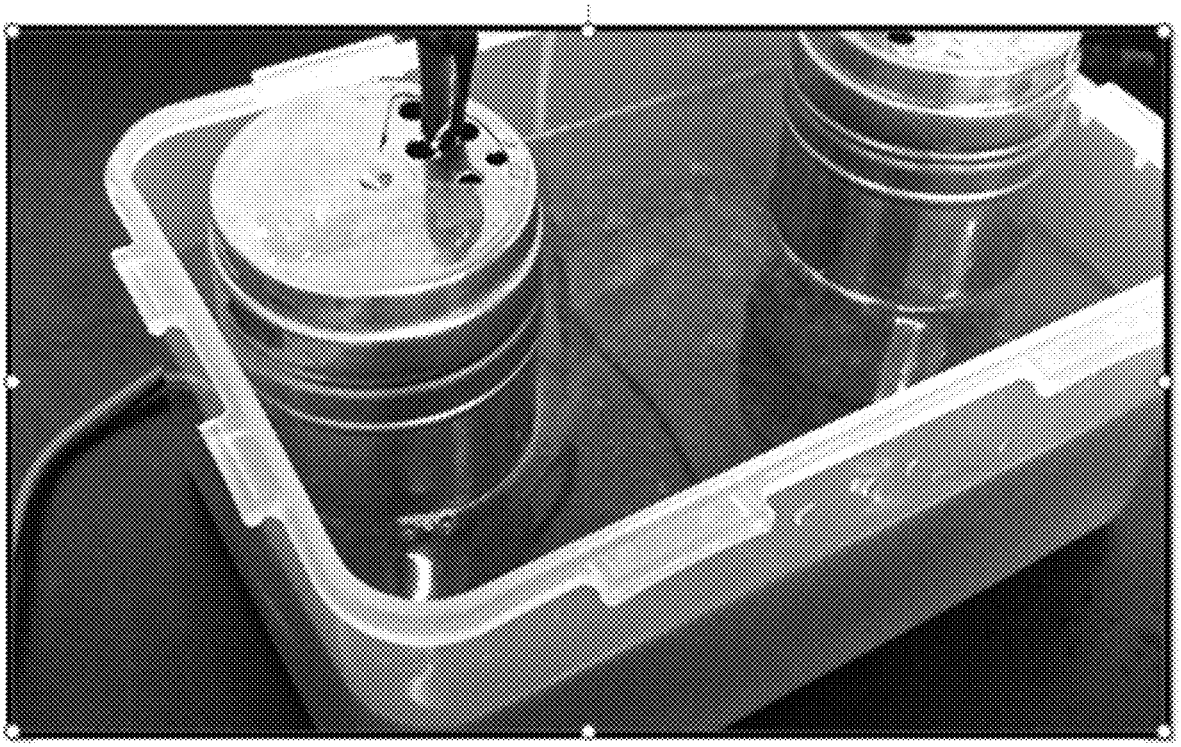
FIG. 4 is a closeup view of the setup in FIG. 3 illustrating the presence of corrosion in the water after the experiment in FIG. 3.

FIG. 3 is an image of a lab setup for electrolysis of salt water using metallic electrodes. The set-up example in FIG. 3, the classic setup, that is performed in the laboratory of the inventor, is run with voltage of 7.4 volts and current of 1.0 amperes. Therefore, the deposited power is 7.4 watts per second. The experiment is run for 7.5 minutes, depositing 3.33 kilowatts during the entire operation. The above classical metallic electrodes experiment resulted in high corrosion rate, bad water conditions due to the chlorine emission and brown corrosion deposits, as illustrated in FIG. 4, which depicts the lab setup in FIG. 3 after the experiment has been completed.

TABLE 1

Porosity and permeability of some core samples from the Earth's surface

| Sample No | Sample ID | Sample dia. (mm) | Sample Length (mm) | Bulk Vol. (cc) | Weight (g) | Grain Vol (cc) | Pore Vol. (cc) | Grain dens. (g/cc) | Core Porosity (%) | Perm. (md) |
|---|---|---|---|---|---|---|---|---|---|---|
| 1 | A1 | 25.40 | 68.19 | 34.55 | 63.47 | 23.72 | 10.83 | 2.68 | 31.35% | 657.681 |
| 2 | A2 | 25.38 | 68.06 | 34.43 | 63.78 | 24.01 | 10.42 | 2.66 | 30.26% | 584.575 |
| 3 | A3 | 25.38 | 67.28 | 34.04 | 63.29 | 23.63 | 10.41 | 2.68 | 30.58% | 620.219 |
| 4 | A4 | 25.50 | 67.61 | 34.53 | 64.08 | 23.99 | 10.54 | 2.67 | 30.52% | 445.657 |
| 5 | A5 | 25.43 | 67.78 | 34.43 | 63.74 | 23.71 | 10.72 | 2.69 | 31.14% | 535.422 |
| 6 | B1 | 25.50 | 71.26 | 36.39 | 67.11 | 24.84 | 11.55 | 2.70 | 31.74% | 235.784 |
| 7 | B2 | 25.44 | 71.52 | 36.35 | 66.85 | 24.70 | 11.65 | 2.71 | 32.05% | 220.742 |
| 8 | B3 | 25.46 | 71.34 | 36.32 | 67.26 | 24.72 | 11.60 | 2.72 | 31.94% | 224.831 |
| 9 | B4 | 25.38 | 71.44 | 36.14 | 67.21 | 24.75 | 11.39 | 2.72 | 31.52% | 193.957 |
| 10 | B5 | 25.40 | 71.61 | 36.29 | 67.63 | 25.00 | 11.29 | 2.71 | 31.11% | 250.621 |
| 11 | C1 | 25.44 | 71.85 | 36.52 | 68.49 | 25.10 | 11.42 | 2.73 | 31.27% | 165.651 |
| 12 | C2 | 25.38 | 71.91 | 36.38 | 68.70 | 25.36 | 11.02 | 2.71 | 30.29% | 185.406 |
| 13 | C3 | 25.40 | 71.34 | 36.15 | 67.79 | 24.99 | 11.16 | 2.71 | 30.87% | 168.81 |
| 14 | C4 | 25.40 | 71.45 | 36.20 | 68.37 | 25.12 | 11.08 | 2.72 | 30.61% | 186.688 |
| 15 | C5 | 25.40 | 71.70 | 36.33 | 68.35 | 25.10 | 11.23 | 2.72 | 30.91% | 208.358 |
| 16 | D1 | 25.40 | 68.60 | 34.76 | 65.51 | 24.49 | 10.27 | 2.67 | 29.55% | 71.432 |
| 17 | D2 | 25.38 | 69.70 | 35.26 | 66.00 | 24.63 | 10.63 | 2.68 | 30.15% | 125.1065 |
| 18 | D4 | 25.35 | 69.32 | 34.99 | 65.75 | 24.47 | 10.52 | 2.69 | 30.07% | 60.898 |
| 19 | D5 | 25.40 | 69.88 | 35.41 | 65.75 | 24.96 | 10.45 | 2.63 | 29.51% | 44.846 |

A sedimentary rock core or other portion used for an electrode in performing electrolysis of a salt water solution may have a porosity and permeability within ranges that include, but are not limited to, the porosity and permeability The subject matter described herein includes two exemplary solutions to the corrosion problem in sea water electrolysis operations with unlimited power that can be deposited for a high rate of hydrogen gas production.

First Solution

Figure 5:
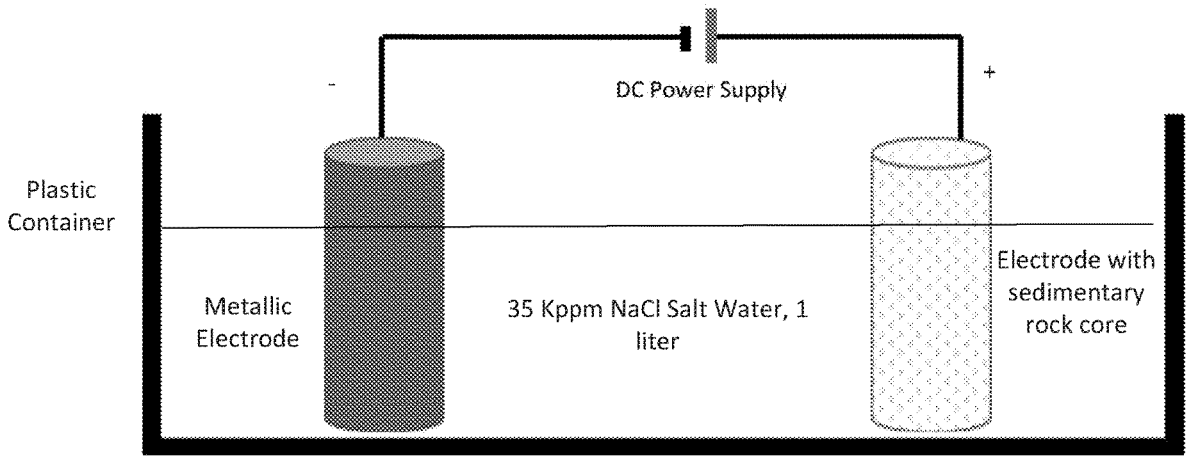
FIG. 5 is a schematic and circuit diagram illustrating an exemplary system for electrolysis of a salt water solution using a metallic electrode and an electrode with a sedimentary rock portion.
Figure 6:
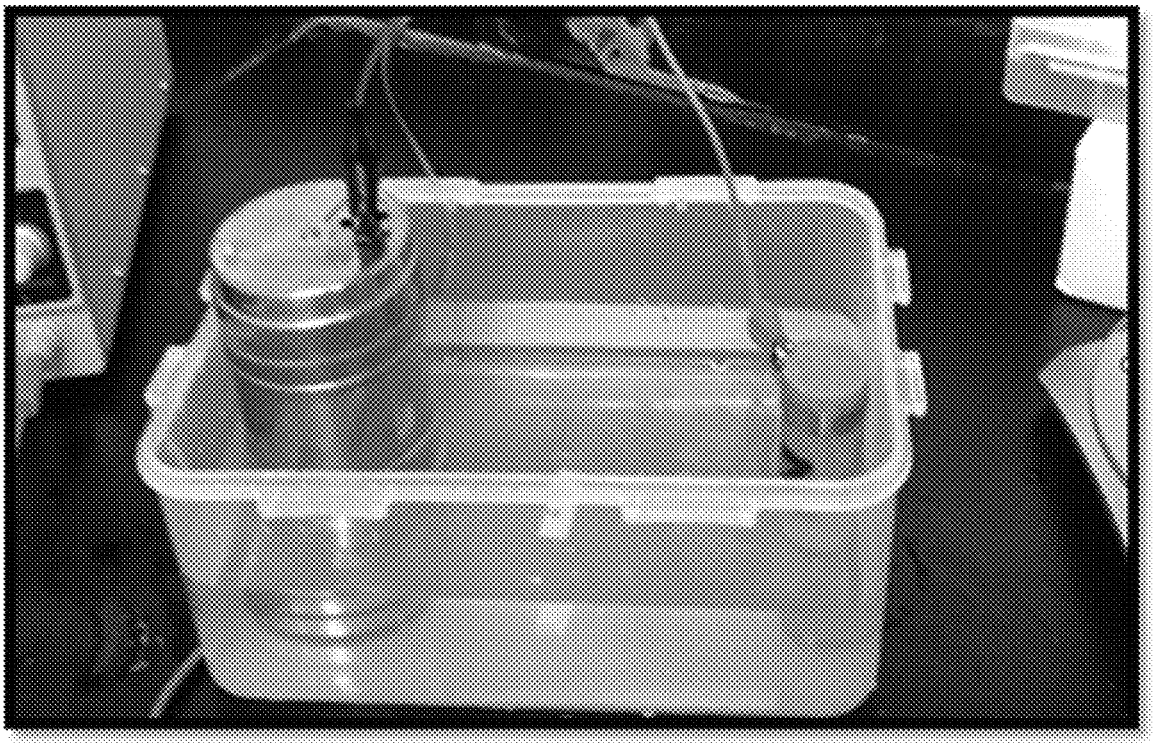
FIG. 6 is an image of an exemplary lab setup for electrolysis of a salt water solution using a metallic electrode and an electrode with a sedimentary rock portion.

The first solution is based on replacing the positive electrode with a salt water saturated sedimentary rock core plug that has high porosity and high permeability, as indicated in Table 1. The setup illustrated in FIG. 5 and FIG. 6 replaces the metallic positive electrode in FIGS. 2 and 3 with an electrode with a sedimentary rock core. The positive electrode may include a metallic band, shown in FIG. 6, that at least partially or fully surrounds the sedimentary rock core. The sedimentary rock core may be saturated with the salt water solution in which the sedimentary rock core is at least partially submerged.

Figure 7:
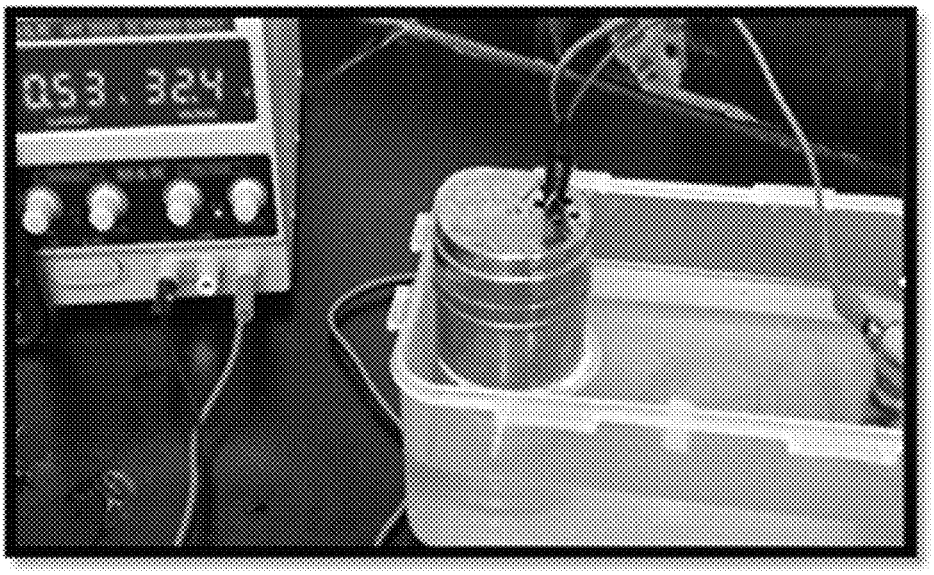
FIG. 7 is an image of an experiment conducted using the setup in FIG. 6 illustrating voltage and current applied by a DC power supply.

FIG. 7 illustrates that the current is lower compared to the current in the classic metallic setup. The voltage used is 32.4 volts, and the current is 0.53 amperes. The deposited power is 17.5 watts per second, which is more than twice (2.4 times) the power deposited in the metallic electrodes in FIG. 2. The reason for running the setup at high power is to examine the condition of the water and the corrosion process at high power rates.

Figure 8:
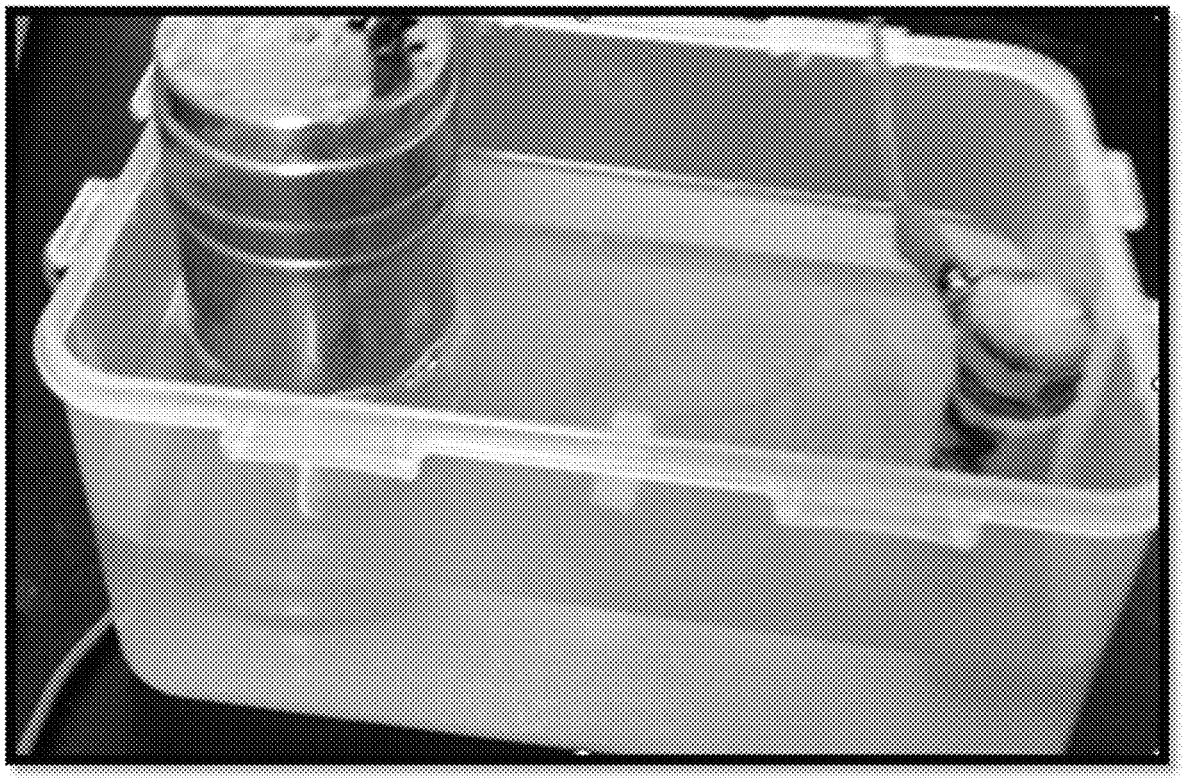
FIG. 8 is an image of the setup after the experiment in FIG. 7 illustrating no visible evidence of corrosion in the water.

FIG. 8 shows the water condition after 30 minutes of operation. During that time, the water electrolysis dragged around 32 kilowatts, compared to 3.33 kilowatts in the classical metallic electrodes experiment shown in FIG. 4. The experiment illustrated in FIG. 8 shows reduced corrosion, even at high power levels, when compared with the experiment illustrated in FIG. 4.

Figure 9:
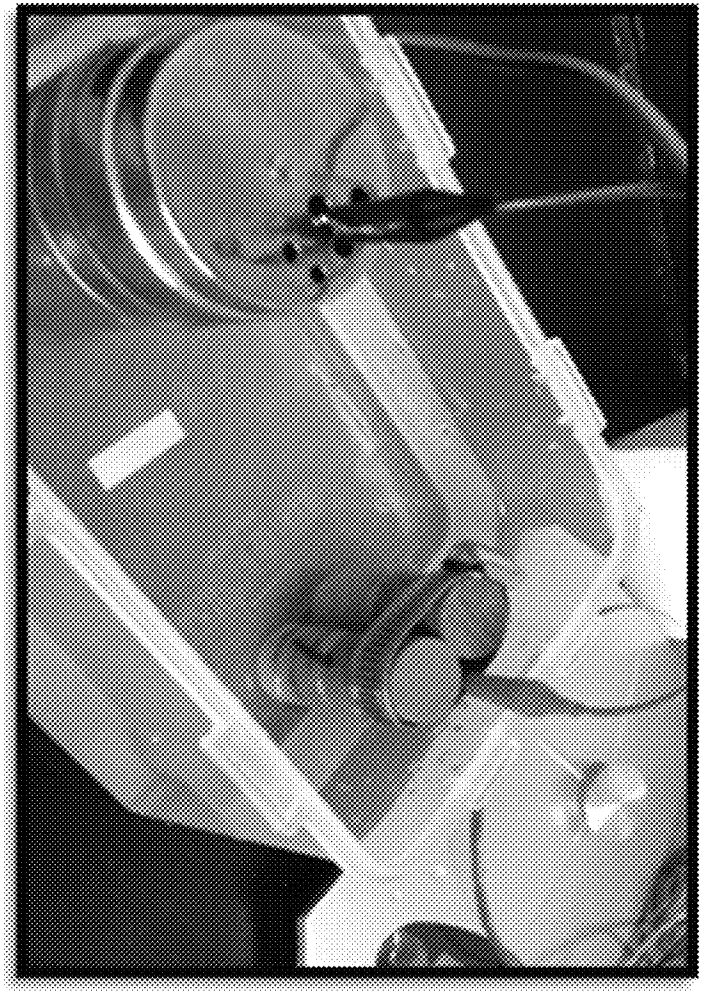
FIG. 9 is an image of an alternate implementation of the subject matter described herein in which two sedimentary rock plugs are banded with a metallic band to form the positive electrode.

The user of the subject matter described herein can increase the dragged current and power by having multiple electrodes connected in parallel instead of a single electrode. This setup decreases the resistance of the non-metallic electrode and results in higher current flow and higher power. The setup is shown in FIG. 9. In FIG. 9, two sedimentary rock core electrodes are connected in parallel. In FIG. 9, the two sedimentary rock core electrodes are banded by a single metallic band, which in the illustrated example is a hose clamp.

Figure 10A:
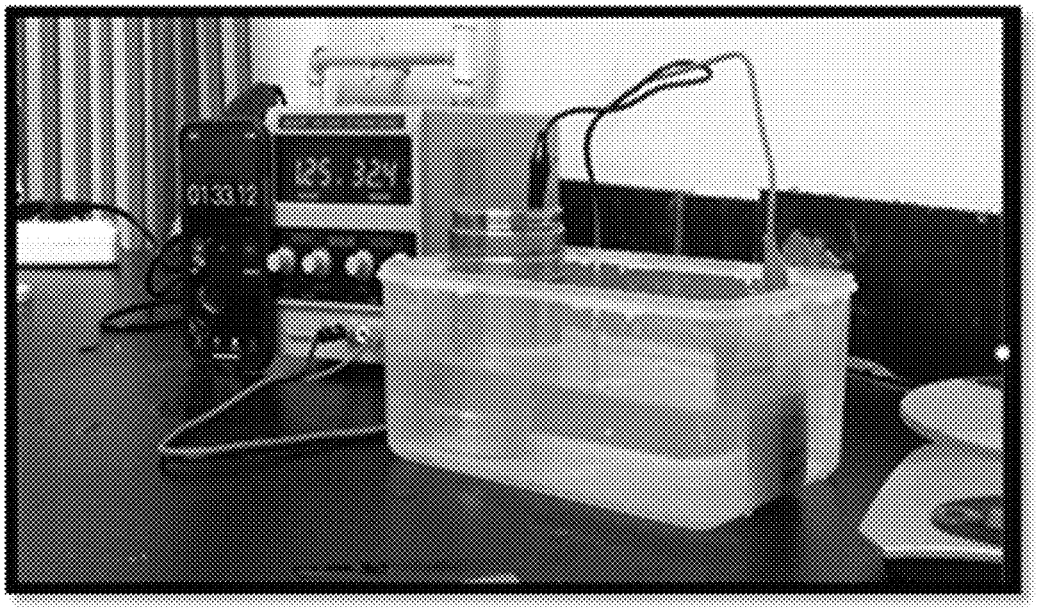
FIG. 10A is an image illustrating voltage and current applied by the DC power supply to the electrode configuration illustrated in FIG. 9.

The voltage and the current during the second setup are shown in FIG. 10A. The dragged current in the new setup is 1.25 amperes compared to 0.56 amperes when only one plug was used. This setup drags 40 watt-seconds. This is a very high power deposited in electrolysis as compared to solar cell capabilities used in other laboratories.

Figure 10B:
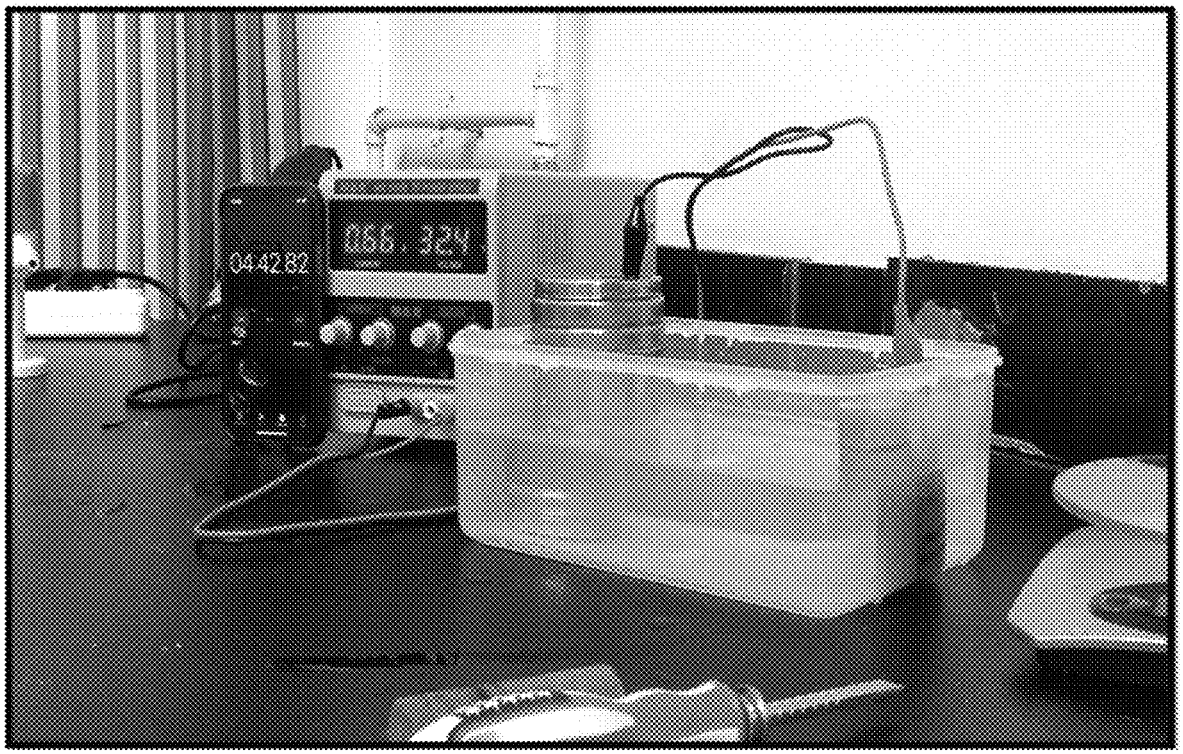
FIGS. 10B and 10C are images illustrating results of the experiment in FIG. 10A after 4.42 and 5.28 minutes, respectively.
Figure 10C:
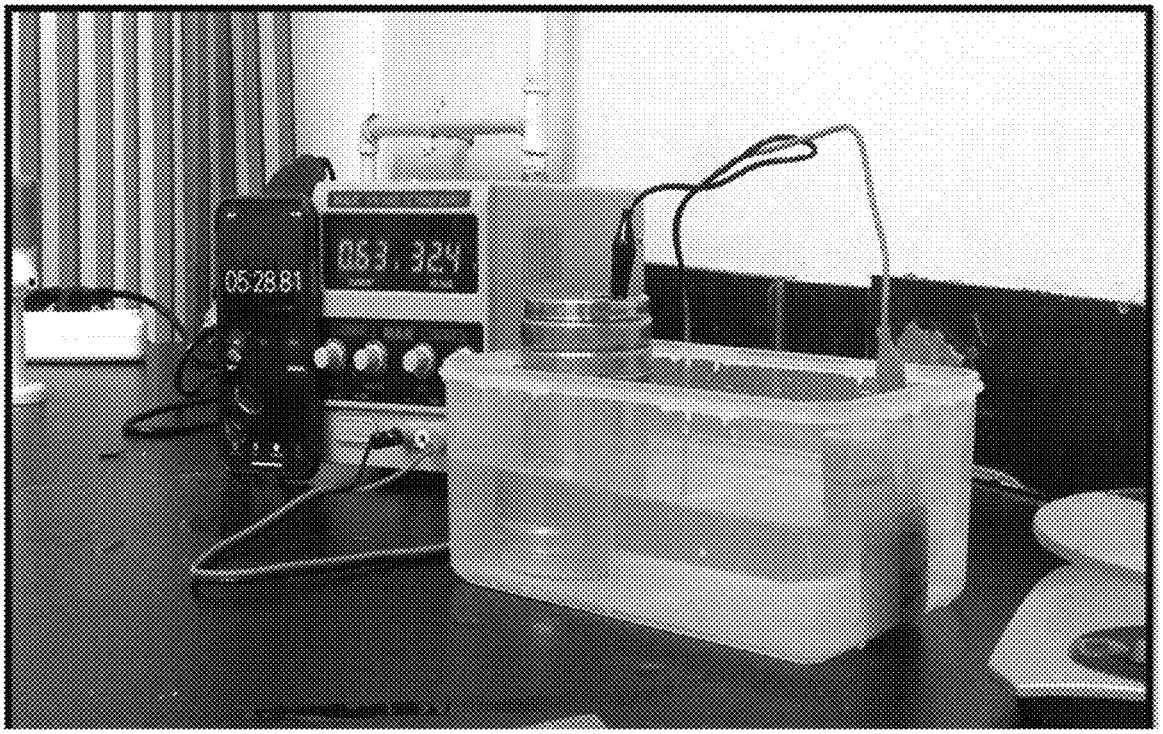

FIGS. 10B and 10C are images illustrating results of the experiment in FIG. 10A after 4.42 and 5.28 minutes, respectively. The water is much clearer than that of the traditional experiment performed using metallic electrodes, the result of which is shown in FIG. 4. The difference is that the power deposited in this experiment is 18.2 kilowatts, as compared to 3.33 kilowatts deposited in the classical experiment. No corrosion effects are visible in the examples illustrated in FIGS. 10B and 10C.

Second Solution

Figure 11:
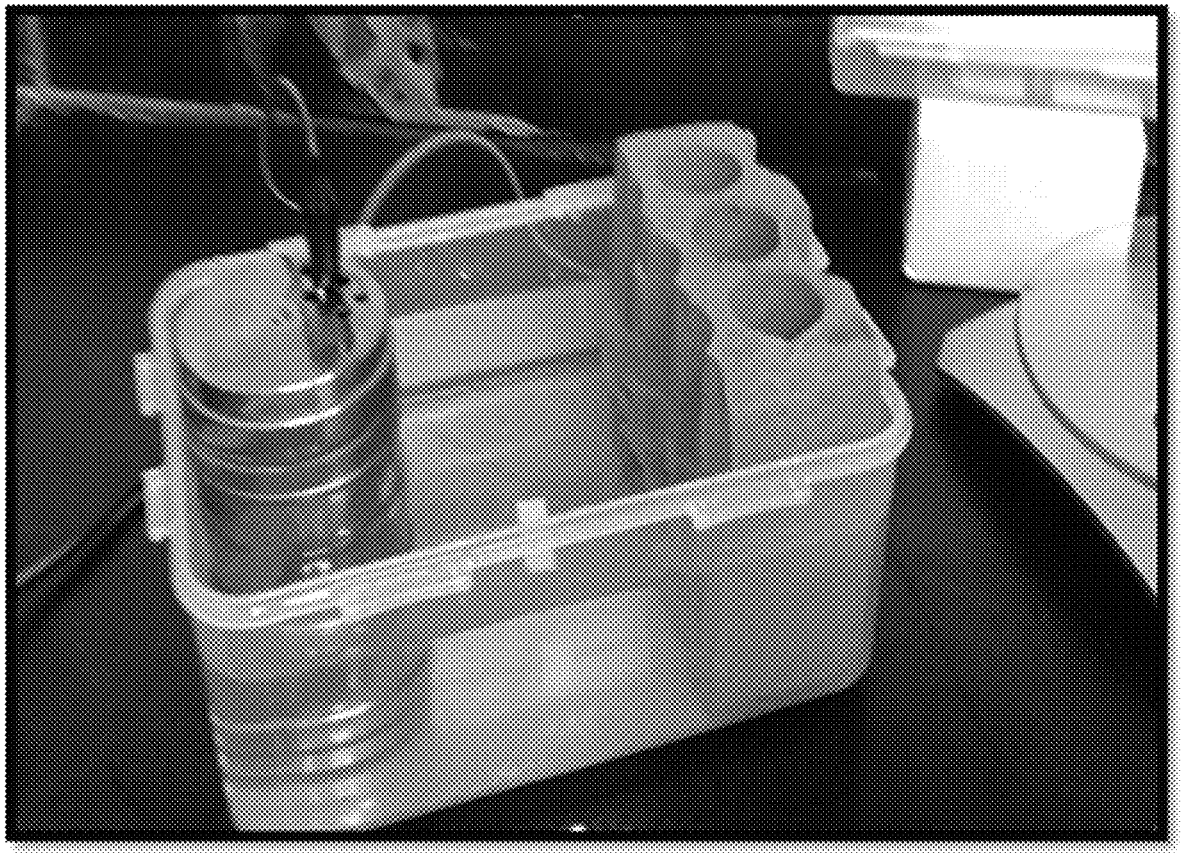
FIG. 11 is an image of an alternate implementation of the subject matter described herein in which the positive electrode comprises a sedimentary rock material with a plurality of internal cavities.
Figure 12:
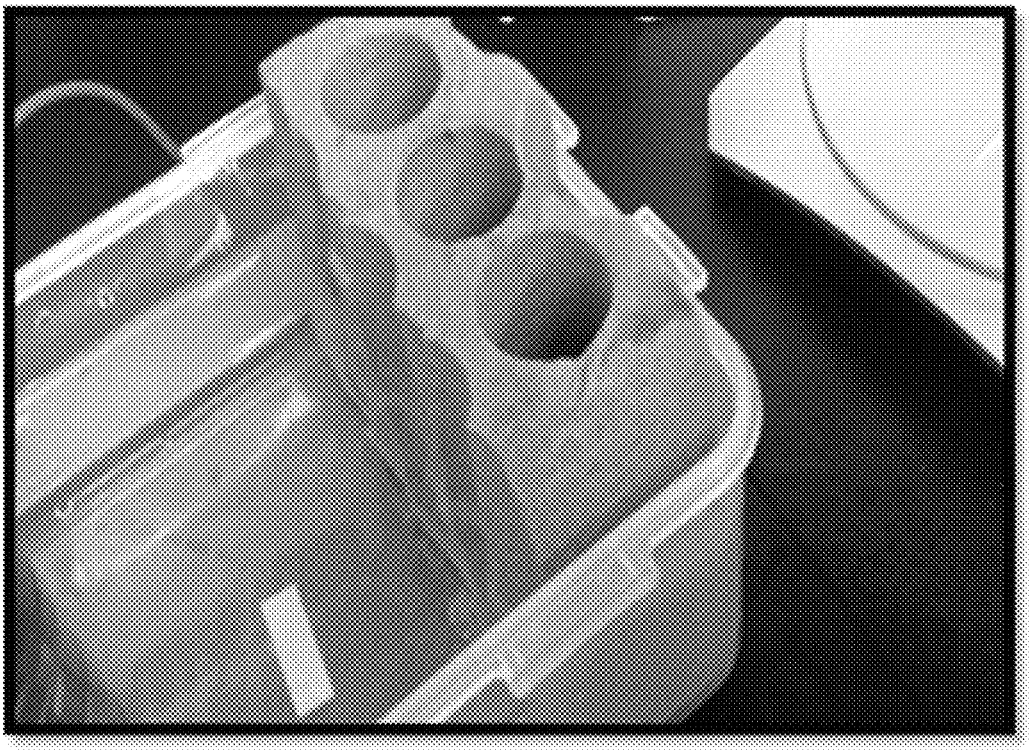
FIG. 12 is a closeup view of the sedimentary rock material with the plurality of internal cavities illustrated in FIG. 11.

In this solution provided by the subject matter described herein, the positive electrode is hollow rock plugs, rather than solid plugs as in the first solution. The hollow rock is filled with the saline water. The electricity can be connected using a metallic pin or using a metallic strip around the core. FIGS. 11 and 12 show the second solution provided by the subject matter described herein. In FIGS. 11 and 12, the positive electrode comprises a sedimentary rock with a plurality of cylindrical holes bored in the rock. The cylindrical holes are at least partially filled with salt water when the sedimentary rock is placed in the container that is partially filled with salt water.

Figure 13:
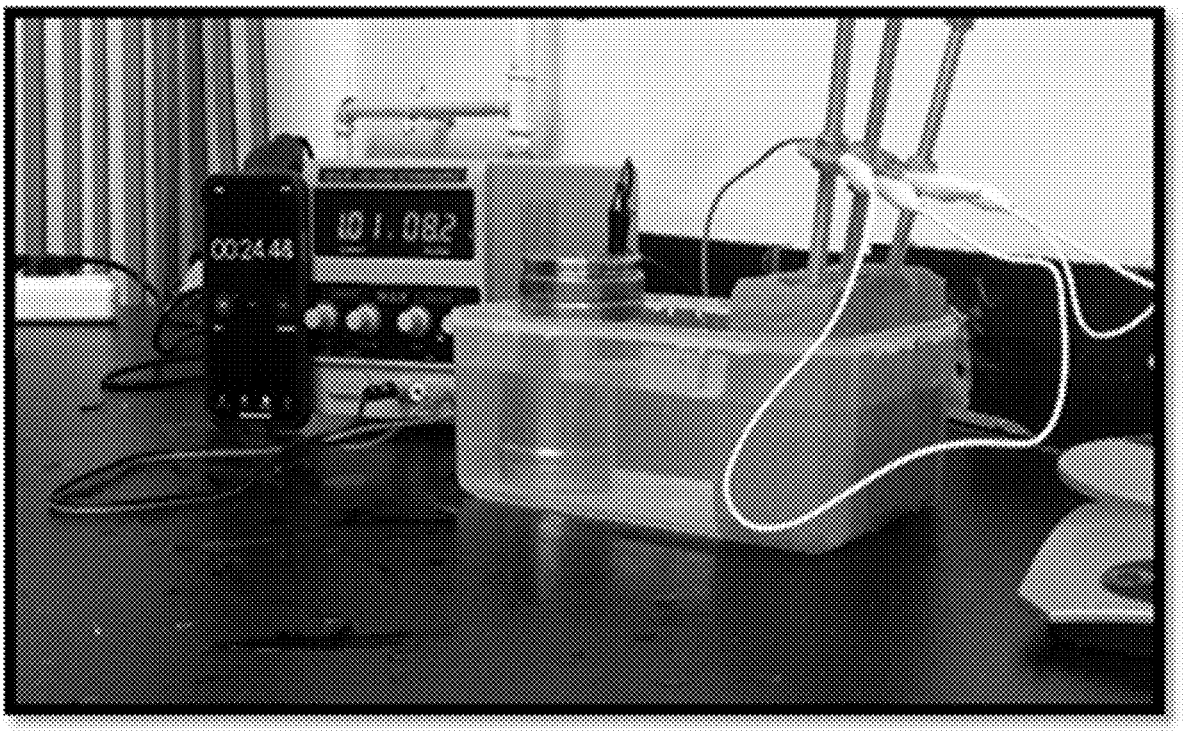
FIG. 13 is an image of an electrolysis experiment conducted using the configuration illustrated in FIG. 11.

FIG. 13 illustrates exemplary current and voltages measurements for the second solution. As illustrated in FIG. 13, the dragged current in this setup is 1.0 ampere at 8.2 volts. This is the same setup as the metallic setup, which dragged 1.0 ampere at 7.4 volts.

The second solution provided by the subject matter described herein drives comparable voltage, 8.2 volts versus 7.4 volts, and the same current, 1.0 ampere, as the metallic setup, providing an excellent solution to the corrosion problem in the classical setup.

Figure 14:
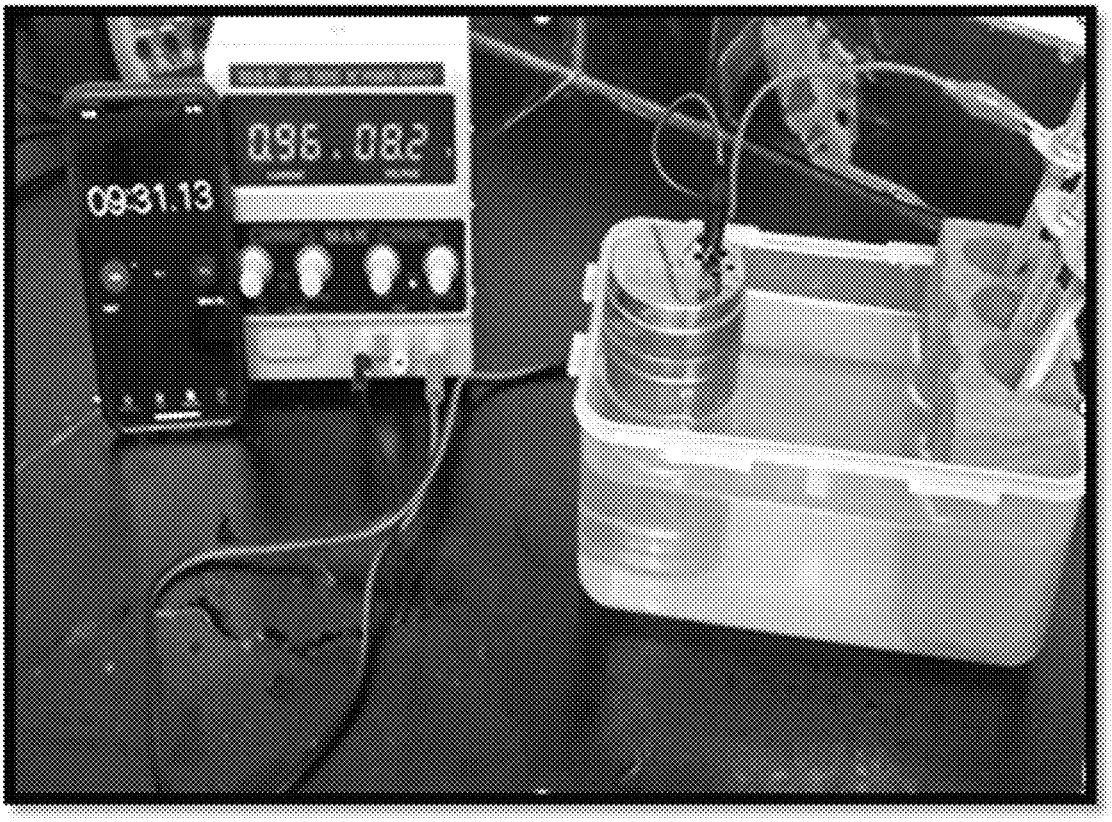
FIG. 14 is a diagram illustrating current and voltage applied to the setup illustrated in FIG. 11.

The water condition after 10 minutes of operation using the second setup of this invention is shown in FIG. 14. The clarity of the water in FIG. 14 indicates no visible signs of corrosion.

Figure 15:
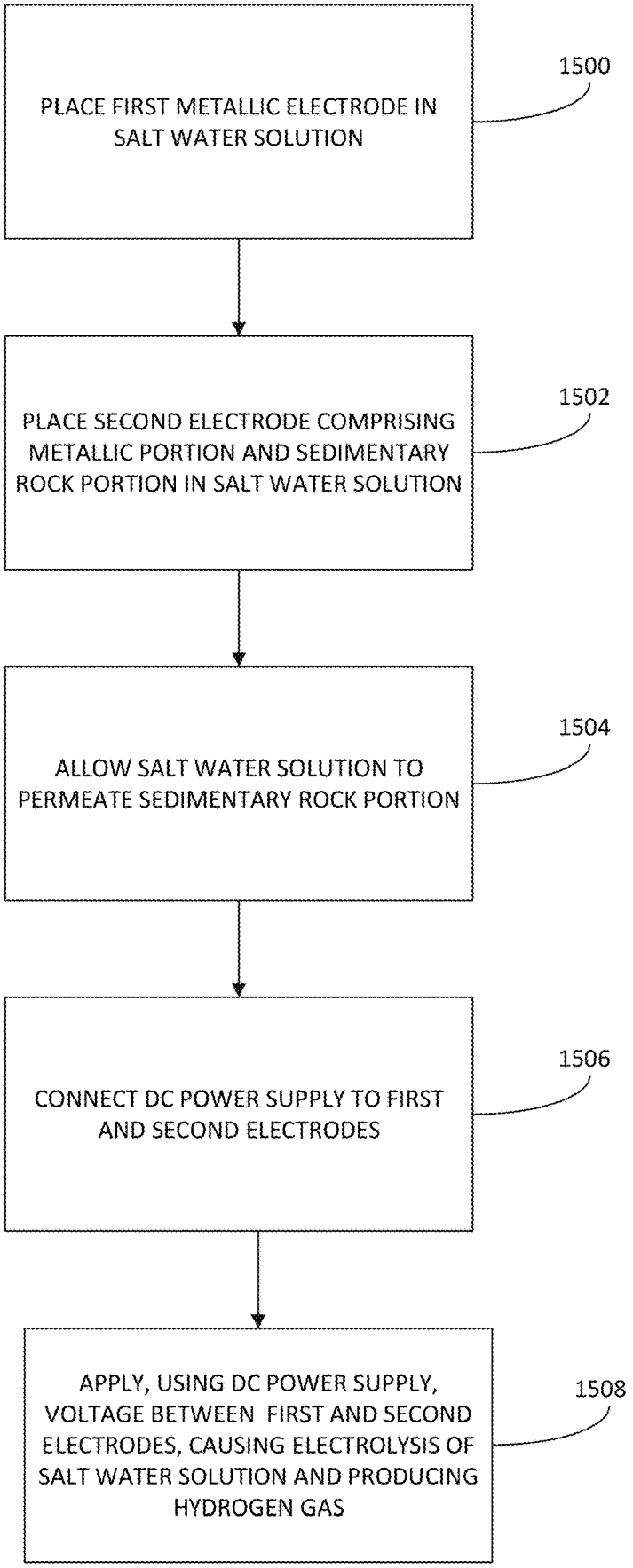
FIG. 15 is a flow chart illustrating an exemplary process for electrolysis of a salt water solution using an electrode with a sedimentary rock portion.

Accordingly, the subject matter described herein includes a method for producing hydrogen gas through electrolysis of a salt water solution using an electrode with a sedimentary rock portion. FIG. 15 is a flow chart illustrating such a process. Referring to FIG. 15, in step 1500, the process includes placing a first metallic electrode in a salt water solution. In one example, the salt water solution is sea water with a concentration of dissolved metallic salts, including one or more of sodium chloride, potassium chloride, magnesium chloride, etc.

In step 1502, the process further includes placing a second electrode comprising a metallic material portion and a sedimentary rock portion into the salt water solution. For example, the second electrode may include a sedimentary rock core, as illustrated in FIGS. 5-10 or a sedimentary rock including a hollow interior region or cavity, as illustrated in FIG. 11 or 12. The sedimentary rock material may be one or more sedimentary rocks, including, but not limited to, sandstone, limestone, and dolomite. Any suitable porous rock material that can conduct electricity when immersed in a salt water solution can be used.

In step 1504, the process further includes allowing the salt water solution to permeate the sedimentary rock portion. For example, because the sedimentary rock portion of the electrode is porous, when the electrode is at least partially submerged in the salt water solution, the salt water solution enters the pores in the rock, lowering the electrical resistance of the rock.

In step 1506, the method further includes connecting a direct current (DC) power supply to the first and second electrodes. For example, a DC power supply may be connected to the metal of the first electrode using a wire or other electrical conductor and to the metallic portion of the second electrode using a wire or other electrical conductor. The DC power supply may supply energy from any suitable renewable or non-renewable energy source, including, but not limited to a solar energy source, a wind energy source, a hydroelectric energy source, a fossil-fuels-based energy source, or a nuclear energy source.

In step 1508, the process further includes applying, using the power supply, a DC voltage between the first and second electrodes, thereby causing electrolysis of at least a portion of the salt water solution and producing hydrogen gas. For example, the negative lead of the DC power supply may be connected to the first electrode, and the positive lead of the DC power supply may be connected to the second electrode. The power supply may then be activated, creating a potential difference between the first and second electrodes and causing a current to flow between the first and second electrodes.

Conclusion

The subject matter described herein provides a superior solution to the corrosion problem encountered during the sea water electrolysis using the metallic electrodes. The solution is a very low-cost solution, available everywhere since it is surface sedimentary rock, and has no limits on current, voltage or power deposited in the electrolysis system.

It will be understood that various details of the subject matter described herein may be changed without departing from the scope of the subject matter described herein. Furthermore, the foregoing description is for the purpose of illustration only, and not for the purpose of limitation, as the subject matter described herein is defined by the claims as set forth hereinafter.

What is claimed is:

1. A method for producing hydrogen gas through electrolysis of a salt water solution using an electrode with a sedimentary rock portion, the method comprising:

placing a first electrode comprising a metallic material in a salt water solution;

placing a second electrode comprising a metallic material portion and a sedimentary rock portion into the salt water solution, wherein the sedimentary rock portion comprises a cylindrical core comprising a sedimentary rock material and the metallic portion comprises a band that at least partially surrounds the cylindrical core;

allowing the salt water solution to permeate the sedimentary rock portion;

connecting a direct current (DC) power supply to the first and second electrodes; and applying, using the DC power supply, a DC voltage between the first and second electrodes, thereby causing electrolysis of at least a portion of the salt water solution and producing hydrogen gas.

2. The method of claim 1 wherein the salt water solution comprises a sea water solution.

3. The method of claim 2 wherein the sea water solution has a concentration of sodium chloride of about 35 thousand parts per million.

4. The method of claim 1 wherein the first electrode comprises a negative electrode.

5. The method of claim 1 wherein the second electrode comprises a positive electrode.

6. The method of claim 5 wherein the sedimentary rock portion comprises at least one of sandstone, limestone, and dolomite.

7. The method of claim 5 wherein the sedimentary rock portion comprises a porosity in a range of about 29.5% to about 32%.

8. The method of claim 5 wherein the sedimentary rock portion comprises a permeability in a range of about 40 millidarcy (md) to about 660 md.

9. The method of claim 1 wherein the sedimentary rock portion comprises a sedimentary rock including a cavity and the metallic portion is inserted within the cavity.

10. The method of claim 1 wherein the DC power supply supplies power from a renewable or a non-renewable energy source.

11. A method for producing hydrogen gas through electrolysis of a salt water solution using an electrode with a sedimentary rock portion, the method comprising:

placing a first electrode comprising a metallic material in a salt water solution;

placing a second electrode comprising a metallic material portion and a sedimentary rock portion into the salt water solution, wherein the sedimentary rock portion comprises a plurality of cylindrical cores including a sedimentary rock material;

allowing the salt water solution to permeate the sedimentary rock portion;

connecting a direct current (DC) power supply to the first and second electrodes; and applying, using the DC power supply, a DC voltage between the first and second electrodes, thereby causing electrolysis of at least a portion of the salt water solution and producing hydrogen gas.

12. The method of claim 11 wherein the metallic portion comprises a band that at least partially surrounds the cylindrical cores.

13. A system for producing hydrogen gas through electrolysis of a salt water solution using an electrode with a sedimentary rock portion, the system comprising:

a first metallic electrode;

a second electrode comprising a metallic material portion and a sedimentary rock portion, wherein the sedimentary rock portion comprises a cylindrical core comprising a sedimentary rock material and the metallic portion comprises a band that at least partially surrounds the cylindrical core;

a container for holding the first and second electrodes and at least partially submerging the first and second electrodes in a salt water solution; and a direct current (DC) power supply for connecting to the first and second electrodes and applying a DC voltage to the first and second electrodes when the electrodes are at least partially submerged in the salt water solution, thereby causing electrolysis of at least a portion of the salt water solution and producing hydrogen gas.

14. The system of claim 13 wherein the sedimentary rock portion comprises at least one of sandstone, limestone, and dolomite.

15. The system of claim 13 wherein the sedimentary rock portion comprises a sedimentary rock including a cavity and the metallic portion is inserted within the cavity.

16. A system for producing hydrogen gas through electrolysis of a salt water solution using an electrode with a sedimentary rock portion, the system comprising:

a first metallic electrode;

a second electrode comprising a metallic material portion and a sedimentary rock portion, wherein the sedimentary rock portion comprises a plurality of cylindrical cores including a sedimentary rock material;

a container for holding the first and second electrodes and at least partially submerging the first and second electrodes in a salt water solution; and a direct current (DC) power supply for connecting to the first and second electrodes and applying a DC voltage to the first and second electrodes when the electrodes are at least partially submerged in the salt water solution, thereby causing electrolysis of at least a portion of the salt water solution and producing hydrogen gas.

* * * * *